United States Patent [19]

McGhee et al.

[11] 3,955,632

[45] May 11, 1976

[54] PIPE LAYING APPARATUS

[76] Inventors: Harce McGhee, Box 101, Brookfield, Ga. 31727; Richard S. Sapp, Rte. 1, Enigma, Ga. 31749

[22] Filed: Dec. 2, 1974

[21] Appl. No.: 528,638

[52] U.S. Cl. ..... 175/22; 61/72.1; 173/24

[51] Int. Cl.[2] ..... E21B 11/02

[58] Field of Search ..... 61/72.1, 72.7, 72.5; 175/62, 22, 23, 53, 388; 173/36, 24

[56] References Cited

UNITED STATES PATENTS

| | | | |
|---|---|---|---|
| 740,521 | 10/1903 | Brown | 61/72.7 |
| 1,932,068 | 10/1933 | Englebright et al. | 175/62 X |
| 1,993,366 | 3/1935 | Englebright | 175/62 X |
| 2,165,666 | 7/1939 | Tilly | 175/62 X |
| 2,639,931 | 5/1953 | Kandle | 175/62 X |
| 2,823,898 | 2/1958 | Bankston | 175/62 X |

*Primary Examiner*—Dennis L. Taylor
*Attorney, Agent, or Firm*—James B. Middleton

[57] ABSTRACT

Pipe laying apparatus wherein pipe drawing means are fixed to one end of a pipe and serve to pull a pipe through the ground as the pipe is rotated. The pipe is supported from a track, and a carriage movable along the track includes means for rotating the pipe. The pipe drawing means includes a gimlet to provide a hole substantially the same size as the pipe, and a propeller carried by the gimlet provides forward motion of the gimlet.

9 Claims, 5 Drawing Figures

PIPE LAYING APPARATUS

This invention relates to pipe laying apparatus, and is more particularly concerned with apparatus wherein a pipe is drawn through the ground and guided in its passage.

There are numerous instances in which a pipe or conduit is to be placed through an embankment, such as beneath a railway, a road or the like. In most such instances it is highly desirable to insert the pipe through the dirt rather than to dig a ditch and bury the pipe, the latter course being very time consuming and requiring interruption of traffic during the construction. Numerous forms of apparatus has been devised to insert a pipe through the ground; however, most of these prior art devices have taken the form of means to remove dirt to provide a tunnel through which a pipe or the like is passed. Other prior art devices comprise means for driving a pipe through the ground.

Presently, when a pipe is placed beneath a road or the like, removal of dirt to form a tunnel is not allowed because of the difficulty of replacing dirt and packing it sufficiently to prevent a surface depression above the tunnel. Thus, the prior art apparatus that digs a tunnel for laying a pipe is of little value. Though driving a pipe beneath a road or the like is allowed, an extremely large force is required to drive a pipe through well packed soil, especially when the soil contains gravel and the like as one normally finds in road beds. Also, whether a device digs a tunnel or simply drives a pipe, there is a difficulty in assuring that the pipe will travel along a straight line since most apparatus will tend to deviate from a straight line when an obstacle is encountered.

The present invention overcomes the above mentioned and other difficulties with the prior art pipe laying apparatus by providing means for drawing a pipe through the ground, and means for guiding the pipe as it is drawn through the ground. The means for drawing the pipe through the ground includes a tapered gimlet having propelling means thereon, the gimlet being fixed to a pipe and rotatable by the pipe. The guide means includes a track for locating the pipe and holding the pipe in proper alignment during the pipe laying operation.

The present invention therefore provides very simple apparatus by which a pipe or conduit can be laid beneath a road bed or the like, the apparatus requiring relatively low force to lay the pipe and assuring that the pipe will be laid in a straight line as desired.

These and other features and advantages of the present invention will become apparent from consideration of the following specification when taken in conjunction with the accompanying drawings in which.

Figure 1:
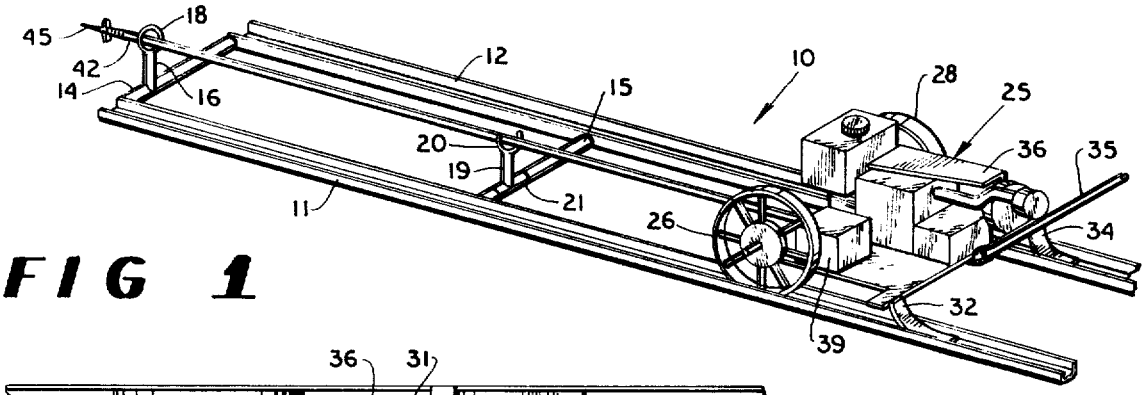
FIG. 1 is a perspective view of one form of pipe laying apparatus made in accordance with the present invention.

Referring now more particularly to the drawings, and to that embodiment of the invention here chosen by way of illustration, the pipe laying machine 10 shown in FIG. 1 of the drawings includes a pair of parallel tracks 11 and 12 fixed together in spaced relation by a pair of cross pieces 14 and 15. The cross piece 14 is at one extreme end of the tracks 11 and 12 and carries an upstanding member 16 having an eye 18 fixed thereto. Similarly, the cross piece 15 has an upstanding member 19 which surmounts a U-shaped bracket 20. The upstanding member 16 on the cross piece 14 is rigidly secured; however, the upstanding member 19 on the cross piece 15 is secured to a cylindrical base 21 which surrounds the cross piece 15, the cross piece 15 being circular in cross section. With this arrangement, it will be seen that the upstanding member 19 and its U-shaped bracket 20 can be rotated about the cross piece 15. The purpose of this arrangement will be discussed hereinafter.

Figure 2:
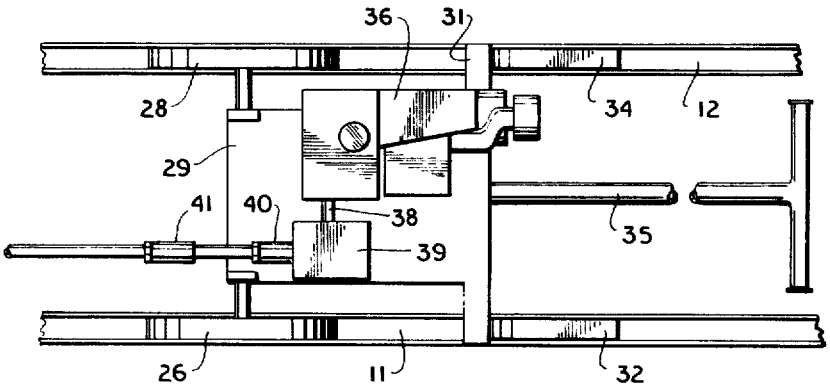
FIG. 2 is a top plan view of the pipe rotating portion of the device shown in FIG. 1.

A carriage 25 is provided for moving along the tracks 11 and 12. The carriage 25 is best shown in FIG. 2 of the drawings and includes a pair of wheels 26 and 28 arranged for moving along the tracks 11 and 12, the wheels 26 and 28 being connected through a platform 29. The rear edge 30 of the platform 29 has a cross member 31 from which depends a pair of rear supports 32 and 34. While the supports 32 and 34 are here shown as arcuate members arranged for sliding motion along the tracks 11 and 12, it will be understood by those skilled in the art that wheels or other support means can be used equally well. Extending upwardly and rearwardly from the platform 29, there is a handle 35 provided for manipulation of the carriage 25.

Mounted on the platform 29 of the carriage 25, there is a motor 36 having its output shaft 38 connected to a gear reducer 39. The output shaft 40 from the gear reducer 39 is provided with means for engaging a pipe for rotation of the pipe. In the embodiment here illustrated, the means for rotating a pipe comprises simply a pipe fitting 41 having a female pipe thread.

With the above described arrangement, it should now be seen that a pipe P will threadedly engage the pipe fitting 41 and lie in the U-shaped bracket 20 and pass through the eye 18. The bracket 20 and the eye 18 are arranged to support the pipe P to lie along a straight line that is parallel to the tracks 11 and 12. The forwardmost end 42 of the pipe P carries the pipe drawing means 45 which will be discussed in more detail hereinafter. With this arrangement, it will be seen that the motor 36 on the carriage 25 rotates, through gear reducer 39, the output shaft 40 which in turn rotates the pipe fitting 41 to rotate the pipe P. The pipe P causes rotation of the pipe drawing means 45 which draws the pipe P through the ground. As the pipe P is inserted into the ground, the carriage 25 will move along the tracks 11 and 12 guiding the end of the pipe. When the carriage 25 reaches the cross member 15, it will be seen that the forward edge of the platform 29 will engage the upstanding member 19 and will push the upstanding member 19 forward causing the cylindrical base 21 to rotate about the cross member 15, thereby allowing the carriage 25 to continue along the tracks 11 and 12. When the carriage 25 reaches the end of the tracks 11 and 12, the pipe P will be released from the pipe fitting 41, the carriage 25 will be manually moved to the opposite end of the tracks 11 and 12, and another length of pipe will be fixed to the pipe P and to the fitting 41. The above described operation will then be repeated.

Additional lengths of pipe will be added until pipe has been laid as desired.

Figure 3:
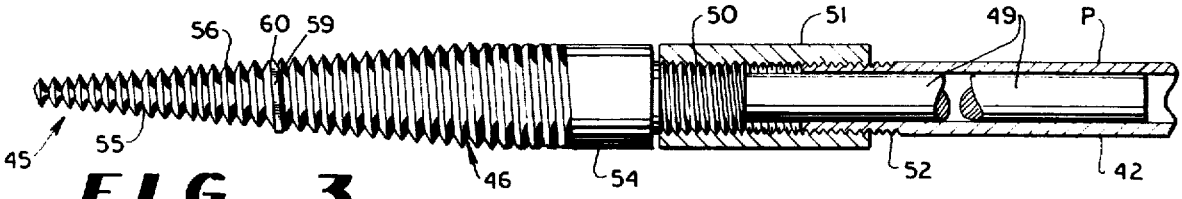
FIG. 3 is an enlarged side elevational view of the pipe drawing means shown in FIG. 1, the pipe being broken away to show the complete construction.
Figure 4:
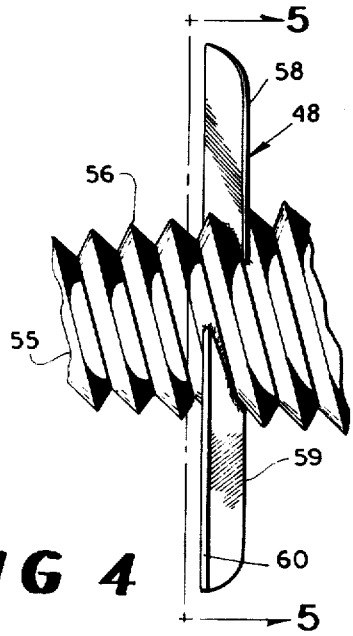
FIG. 4 is an enlarged top plan view of a portion of the device shown in FIG. 3 and illustrating the propelling means; and, FIG. 5 is a cross-sectional view taken substantially along the line 5—5 in FIG. 4.
Figure 5:
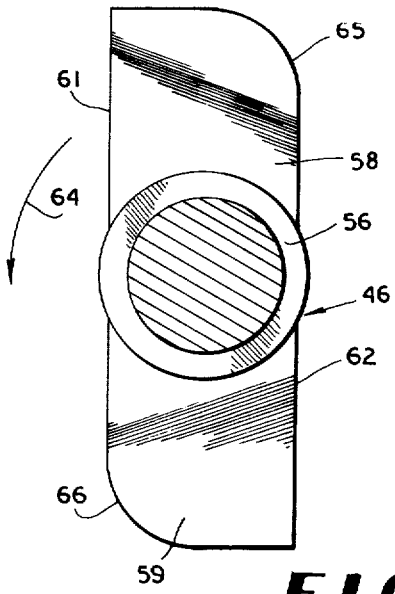

Attention is now directed to FIGS. 3, 4 and 5 of the drawings which show the pipe drawing means 45 in more detail. In general, the pipe drawing means 45 includes a gimlet 46 which carries a propelling means 48. The gimlet 46 is axially aligned with a stub shaft 49 which is formed integrally with the gimlet 46 and includes a male pipe thread 50 at the junction of the gimlet 46 and the shaft 49. As is shown in FIG. 3 of the drawings, the end 42 of the pipe P receives the stub shaft 49 and a pipe sleeve, or coupling, 51 engages both the pipe thread 50 and the threaded end 52 of the pipe P.

It should be realized that the purpose of the gimlet 46 is simply to open a relatively small hole in the ground through which the pipe P can pass. The criterion for the size of the hole is the size of the pipe P, since it is important to have a hole through the ground no larger than the pipe P, and it is somewhat important to have a hole substantially the size of the pipe P to prevent undue resistance to passage of the pipe P through the ground.

In more detail, the gimlet 46 includes a shank 54 having a diameter substantially equal to that of the pipe P, and in no case having a diameter larger than the pipe P. The shank 54 merges into a tapered point 55, and the point 55 is provided with helical threads 56. It whould especially be noted that the threads 56 begin at the tip of the point 55 and are cut throughout the length of the tapered portion, running out when the threads reach the cylindrical shank portion 54. With this arrangement, it should be understood that the point 55 will enter the ground and produce a hole in the ground. As the gimlet 46 moves into the ground, the dirt will be engaged by the threads 56 which will tend somewhat to move the gimlet 46 through the ground; and, as the gimlet 46 moves through the ground, the soil around the gimlet 56 will be moved outwardly due to the increasing diameter of the point 55 of the gimlet 46 until a hole has gradually been created that will be substantially the diameter of the shank 54.

While the threads 56 on the gimlet 46 may tend somewhat to move the gimlet 46 through the ground, the forward force produced by the threads 56 would be insufficient to pull a pipe P through the ground; therefore, an additional propelling means 48 is provided. The propelling means 48 is shown in FIGS. 3, 4 and 5 where it will be seen that the propelling means 48 comprises a pair of propeller blades 58 and 59. Looking first at FIG. 3 of the drawings, it will be seen that the blade 59 is fixed to the gimlet 46 substantially midway thereof and is positioned on the minor diameter of the threaded portion, between the threads 56 to be parallel to the threads 56 as viewed in side elevation. Thus, the blade 59 has a slope, or pitch, equal to the pitch of the threads 56. As also best seen in FIG. 3 of the drawings, the leading edge of the blade 59 is sharpened with a chisel edge 60 for cutting into the earth.

Looking now at FIG. 5 of the drawings, it will be seen that each of the blades 58 and 59 has its leading edge 61 and 62 tangent to the gimlet 46, the propelling means 48 as viewed in FIG. 5 being adapted for rotation counterclockwise as indicated by the arrow 64. The trailing edges 65 and 66 are rounded at their outer ends and become tangent adjacent to the gimlet 46.

It should now be understood that, in operation, the propelling means 45 is mounted on a pipe P as previously described, the pipe P being rotated by means of the motor 36 and the gear reducer 39. In the beginning, the gimlet 46 will enter the ground and the threads 56 on the point 55 will gradually generate an opening in the ground urging the dirt outwardly to create a hole large enough for the shank 54 to pass therethrough. With this procedure, it should be understood that the dirt will be moved outwardly and be packed very tightly by the action of the expanding diameter of the gimlet.

Once the gimlet 46 has entered the ground sufficiently for the propelling means 48 to enter the ground, the blades 58 and 59 will cut into the ground and act as a propeller, or screw, to provide the forwardly directed force to cause the gimlet 46 to move through the ground pulling the pipe P behind it. For the pipe drawing means 45 to deviate from its intended course, it will be necessary for the extending end 42 of the pipe P to bend in order for the gimlet 46 to take a different path. Such a bending is extremely difficult due to the apparatus as shown in FIG. 3 wherein the end 42 of the pipe P is threadedly secured to the pipe drawing means 45 through the sleeve 51 connected both to the pipe P and to the pipe thread 50 of the pipe drawing means 45. The stub shaft 49 lies within the pipe P and is only slightly smaller in diameter than the inside diameter of the pipe P.

As illustrated in FIGS. 1 and 2, the threads on the pipe P are utilized as means for connecting the pipe to the means 41 for rotating the pipe. Alternatively, it will be understood by those skilled in the art that a conventional chuck may be used, and the chuck would be rotated by the motor 36 through appropriate gear reduction such as the gear reducer 39. One advantage of the use of such a chuck is that the pipe P can be passed entirely through a chuck so that the pipe rotating means would not necessarily be fixed to the opposite end of each length of pipe. Such an arrangement would allow a shorter operating track since the track would not have to accommodate a complete pipe length.

It will be obvious to those skilled in the art that these and other modifications may be made, and the full use of equivalents resorted to without departing from the spirit or scope of the invention as defined by the appended claims.

We claim:

1. Pipe laying apparatus, for inserting a pipe through the ground along a straight line, comprising a track disposed parallel to said straight line outside said ground, pipe guide means carried by said track for supporting said pipe parallel to said track and along said straight line, pipe drawing means fixed to one end of said pipe for pulling said pipe through the ground during rotation of said pipe drawing means, and means for rotating said pipe, said pipe drawing means including a gimlet axially aligned with said pipe, and at least one propellor extending outwardly perpendicular to the axis of said gimlet.

2. Pipe laying apparatus as claimed in claim 1, said gimlet having a shank, a stub shaft extending rearwardly of said shank and receivable within said pipe, and means for fixing said pipe relative to said shank.

3. Pipe laying apparatus as claimed in claim 2, said gimlet including a tapered point having a thread, said propellor having a pitch substantially equal to the pitch of said thread.

4. Pipe laying apparatus as claimed in claim 1, said gimlet including a shank and a tapered point formed integrally with said shank forwardly of said shank, said shank having a diameter no larger than the diameter of said pipe.

5. Pipe laying apparatus as claimed in claim 4, said propellor including a plurality of propellors fixed to said tapered point of said gimlet, said propellors being angularly disposed with respect to said straight line.

6. Pipe laying apparatus as claimed in claim 2, said means for rotating said pipe comprising a carriage movable along said track, pipe engaging means carried by said carriage, and pipe rotating means carried by said carriage for rotating said pipe engaging means.

7. Pipe drawing means for pulling a pipe through the ground comprising a gimlet, a shaft coaxial with said gimlet and fixed thereto, said shaft being receivable within said pipe, means for fixing said pipe with resepct to said shaft, said gimlet including a tapered point, a shank contiguous with said tapered point, and at least one propellor carried by said gimlet perpendicularly to the axis of said gimlet.

8. Pipe drawing means as claimed in claim 7, said shank having a diameter no greater than the outside diameter of said pipe.

9. Pipe drawing means as claimed in claim 7, said tapered point including a thread having a pitch, said propellor including a plurality of propellors having said pitch, said plurality of propellors being fixed to said tapered point.

* * * * *